United States Patent [19]

Tobler

[11] Patent Number: 4,900,085

[45] Date of Patent: Feb. 13, 1990

[54] CHAIR CONSTRUCTION ARRANGEMENT, PARTICULARLY FOR OFFICE CHAIRS, TYPING CHAIRS, AND THE LIKE

[75] Inventor: Peter Tobler, Rheineck, Switzerland

[73] Assignee: Equus Marketing AG, Wald, Switzerland

[21] Appl. No.: 214,604

[22] Filed: Jul. 1, 1988

[30] Foreign Application Priority Data

Jul. 24, 1987 [CH] Switzerland ..... 2839/87

[51] Int. Cl.[4] ..... A47C 7/00

[52] U.S. Cl. ..... 297/219; 297/444; 297/452; 297/DIG. 2

[58] Field of Search ..... 297/219, 218, 452, 443, 297/444, DIG. 2, 300, 301

[56] References Cited

U.S. PATENT DOCUMENTS

| | | | |
|---|---|---|---|
| 3,947,068 | 3/1976 | Buhk | 297/DIG. 2 X |
| 4,099,774 | 7/1978 | Sandham | 297/443 X |
| 4,275,925 | 6/1981 | Harder Jr. | 297/452 X |
| 4,385,783 | 5/1983 | Stephens | 297/218 X |
| 4,390,210 | 6/1983 | Wisniewski et al. . | |
| 4,432,582 | 2/1984 | Wiesmann | 297/410 X |
| 4,643,480 | 2/1987 | Morita . | |
| 4,682,814 | 7/1987 | Hansen . | |
| 4,744,603 | 5/1988 | Knoblock | 297/DIG. 2 X |
| 4,783,121 | 11/1988 | Luyk et al. | 297/300 |

FOREIGN PATENT DOCUMENTS

| | | | |
|---|---|---|---|
| 125598 | 11/1984 | European Pat. Off. | 297/218 |
| 524982 | 8/1972 | Switzerland . | |

*Primary Examiner*—Peter R. Brown

*Attorney, Agent, or Firm*—Frishauf, Holtz, Goodman & Woodward

[57] ABSTRACT

To permit use of injection-molded plastic parts in chairs which, otherwise, have a wide variety of coverings or shapes of the seats and/or the chair backs, the seats and chair backs are upholstered with material such as fabric or leather or imitation leather in accordance with selected colors, and made in shapes determined by designers; the back of the chair, and where the coverings are attached to a chair core (45), typically of plywood or the like, is then covered by injection-molded plastic shells or panels (51, 54) which can be snap-in attached by an interengaging attachment means to support brace (27) for the chair back, which support brace may form part of a synchronous seat-back tilting mechanism (15). The seat adjustment tilting mechanism (15) can be identical for any numbers of seats or chair backs, of respectively different shapes (FIGS. 3, 4, 5, 6), thereby permitting inexpensive modular construction and reducing stocking requirements for spare parts.

13 Claims, 2 Drawing Sheets

CHAIR CONSTRUCTION ARRANGEMENT, PARTICULARLY FOR OFFICE CHAIRS, TYPING CHAIRS, AND THE LIKE

BACKGROUND

Chairs of the type to which the present invention relates usually have a covering of textile, leather, or the like for the seat and the chair back. The covering, beneath the chair structure itself, is usually padded, for example by foam material or similar padding.

Fashion colors have invaded also the chair, and particularly office chair market. Color combinations which, in the part, were not considered suitable for many conservative offices are now used frequently. Chairs which are used in such offices present problems to manufacturers. It is necessary for the manufacturer to meet demands and products which not only are adequate for the purpose but, additionally, have the appearance and color combinations desired by customers. For minimum cost, mass production and particularly mass production with only few color combinations is desirable; this also permits stocking of only few replacement components or replacement fabric supplies. On the other hand, different color combinations and many more color schemes than previously considered appropriate are now in demand on the market. There is a basic contradiction between minimum costs based on mass production and desire for variety.

Large series mass production reduces manufacturing costs. Use of injection molding is particularly economical if the injection molds can be used over and over again for many different types of chairs. The costs of the molds are high, and large quantities of products must be made from one mold to justify the cost thereof. If one model of a chair does not find market acceptance, or becomes obsolete due to fashion considerations, costs of molds for injection-molded chairs of that type may not be recoverable.

To avoid the costs for molds, it has been proposed to make chair components as deep drawn elements. Deep drawing tools are cheaper than injection molds; yet, the parts made in such processes are inherently more expensive than mass produced injection molded parts.

Different types of chairs present a further problem to the manufacturer. Chairs are made with highly different comfort and appearance characteristics. Chairs are manufactured, for example, in which the seat and the back are fixed with respect to each other; other types of chairs use individually adjustable seats and back rests. Different adjustment mechanisms are also used. A suitable adjustment mechanism which is frequently used permits changing the inclination of the back rest with a simultaneous change of the inclination of the seat and the spacing of the seat from the back rest. Such chairs are also referred to as synchronous chairs, and, as an example, Swiss Patent 524,982 describes and shows such a chair in detail. The back support carrier is formed as a rod which is extended upwardly behind the back; it is bent by about 90° in order to carry the back rest by means of a flange.

U.S. Pat. No. 4,682,814, Hansen, describes a chair in which the back support is formed as a plastic shell which is somewhat L-shaped. The lower portion of the plastic shell is formed laterally with upwardly bent or bowed side walls and surrounds the rearmost portion of the seat. The upper portion of the plastic shell also has bent-up side walls. These side walls laterally surround the upper part of a back support pad located in the upper portion of the plastic shell. The back support pad, consequently, cannot be seen from the rear.

This chair is highly suitable for many applications, but it has been found that, with changing fashions, the cost of making the shells by injection molding becomes very high. If a change in the shape of the shell is desired, a new mold is necessary. The chair has a large visible surface of plastic which, when looked at from the rear, has a somewhat cold or hard impression. It is, therefore, difficult to match the chair to particular requirements dictated, for example, by overall decor of an office, or by interior designers.

The manufacture of chairs of this type has the additional problems that due, to the wide variety of requirements based on comfort and fashion, or designer's specifications, problems arise in connection with stocking and replacement or repair parts. It is customarily expected that a manufacturer of chairs maintains replacement or repair pairs for some period of time, even though a particular chair may have become out of fashion, or out of stock. Storing chair or chair backs is highly space-consuming, and storage costs, particularly for structures of this type with many individual different shapes, interfere with efficient handling, stocking, and long-term and short-term storing; storage requires substantial capital as well as space which, since only infrequently demanded, increases the cost of replacement parts as well as of the initial chairs, and capital therefor could better be used for other purposes.

The chair of U.S. Pat. No. 4,682,814 is particularly useful when applied to the mechanism which results in the synchronous chairs, in which the back rest is formed by a plastic shell. The "plastic look" of the chair, however, may be undesirable and, therefore, it has been proposed to cover the plastic shell with textiles, leather, imitation leather or the like. Covering such a plastic shell is expensive and has the disadvantage that, in spite of the covering, the back of the chair when handled or touched feels "hard".

THE INVENTION

It is an object to provide a chair construction which can be readily adapted to different requirements of designers, or matched to changes in fashion, or an overall office decor. Further, the chair should be so arranged that designers are free to consider the best possible appearance without being forced into certain arrangements due to the construction of the chair itself; and, as much as possible, types of chairs or families of chairs should be so built that the components thereof can be efficiently manufactured with a high degree of interchangeability of parts to reduce long-term storage and repair part handling problems.

Briefly, a modular arrangement of chairs is obtained, in accordance with a feature of the invention, by extending fabric, leather or similar covering, from the forward side of the back rest over towards a portion of the back side, and then covering the back side with a cover shell which only partially covers the back side.

In accordance with a feature of the invention, the modular system contemplates making a plurality of different support structures for chairs and different seats, each with its associated shapes and colors, and the back rest, likewise, with the respective shapes, parimetrical contours, and colors, as desired; the cover shell itself, in accordance with a feature of the invention, is uniform for all the different chairs, and can be provided, from one mold, in selected colors, as desired. This system permits fast assembly of different types of chairs by combining different supports and seat structures, while using the outer cover shells in accordance with the present invention.

The particular structural arrangement of the cover shell permits making a plurality of different shapes and sizes and comfort characteristics of back rests, without changing the cover shell itself. Thus, the shapes of the back rests and the cover materials may be made as required by any current fashion, designer, or comfort characteristics desired for a particular series of chairs. These seat forms can then be combined with different support spiders or support structures as desired, including structures utilizing the synchronous adjustment of combined tilting of seat and chair back. The construction in accordance with the present invention permits high flexibility to match requirements of the market place. The designer has great freedom in the conception and construction of the back rest, which is frequently one of the most visible parts of a chair. In synchronous chairs, the back support carrier can remain the same for all chairs and the same synchronous adjustment mechanism can be used.

The freedom which the designer is afforded has the additional advantage that specific requirements of various customers and clients of a designer can be considered, to permit individual matching of colors or shapes, for example to fit a specific office decor, demanded by specific customers. Such wishes by the customers or clients can be honored even if only small numbers of series of mass-produced chairs are ordered. If necessary, supplemental orders can be honored, matching those of prior orders, even though they may have occurred years earlier.

It is thus not necessary anymore to buy chairs, throughout the years, which do not match or do not fit with each other or within an overall pattern or color scheme. Rather, a purchasing agent can order chairs, more or less "custom-built" or "custom-designed" although made from mass-production parts, in which the product is individually assembled to fit the requirements of specific customers, and mirror the image of the owners, who use the chairs in their establishments.

Many types and shapes of chairs, thus, may be built utilizing essentially the same elements throughout, which permits manufacture in a most efficient manner, and reduces storage and stocking requirements.

The cover shell may have various shapes, and, for example, and preferably, may have a circular, oval or polygonal outer contour. One or two such arrangements require, therefore, only a minimum number of molds, and permit using the cover shell with a plurality of different forms of back rests. Preferably, the cover shell extends downwardly with an extension tail or element. This extension tail or element can cover, at least in part, the support structure for the back rest so that it will not be visible, and the entire spring or other mechanism is shielded from view, presenting a smooth and uninterrupted outline of the chair when looked at from the back. The particular shape or size or appearance of the extension or tail is not of primary importance, permitting inexpensive manufacture thereof. Chrome-plating or polishing structural elements required for balancing the chair on a support spider or the like, thus, can be eliminated and only such finishing of the metal or adjustment mechanisms is required as is necessary to protect the elements against corrosion or environmental attack.

Drawings, showing various illustrative embodiments:

DETAILED DESCRIPTION

Figure 1:
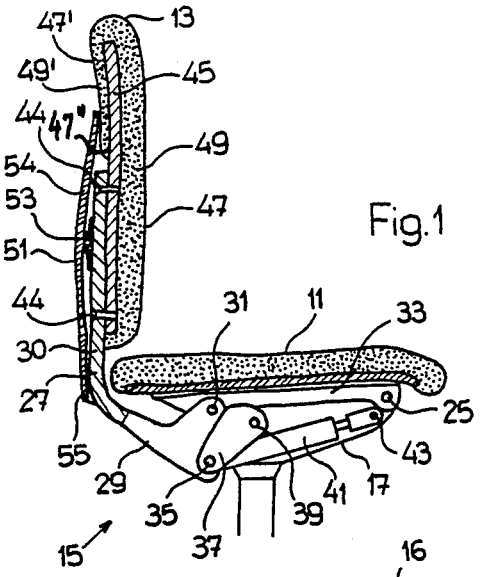
FIG. 1 is a vertical part-sectional view through an office chair in accordance with an embodiment of the invention, omitting unessential features.
Figure 2:
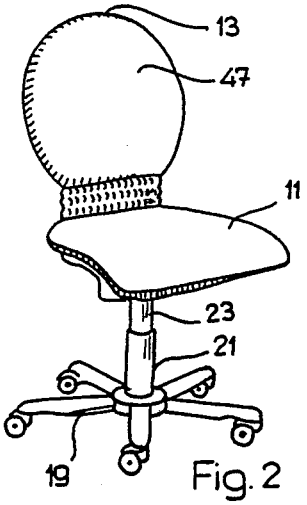
FIG. 2 is a front view of the chair showing one embodiment of the present invention.
Figure 3:
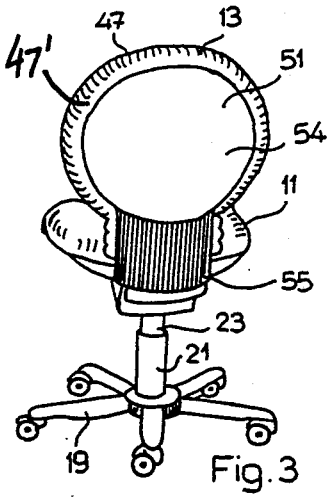
FIG. 3 is a rear view of the chair of FIG. 2.

Referring first to FIGS. 1 to 3: An office chair is shown having a seat 11, a back rest 13, and a common adjustment mechanism 15. The seat and back rest are supported by a support 17. The support 17, as is customary, is supported off the floor by a vertical tubular element 21 with a height adjustment telescoping tubular element 23 (FIGS. 2 and 3), secured to a base spider 19. As best seen in FIG. 1, the forward end or edge portion of the seat 11 is pivotable about a pivot axis 25. The back rest support element 27 is a generally L-shaped part having an arm 29 extending under the seat 11. A pivot axis 31 couples the arm 29 to the seat carrier or seat support 33. A second pivot shaft or pivot axis 35 pivotably couples arm 29 to a lever 37. Lever 37 is pivotably connected with a shaft 39 to the support structure 17. A spring element 41, which can be set in predetermined positions, for example a gas spring, is connected via a link 43 to the forward end of the support 17; it rearward end is pivotably connected with the pivot axis 35.

Basic operation of the chair

If the user of the chair moves the back rest 13 from the position shown in FIG. 1 towards the rear, the seat 11 will carry out a corresponding upwardly tilting movement, changing its angle of inclination with respect to the floor surface or, in the case shown, to the spider 19. The angular change of inclination of the seat 11 is about half of that as the change of inclination of the back rest 13.

The upright part 30 of the L-shaped back rest support carrier 27 is not constructed as a shell structure—as, for example, disclosed in U.S. Pat. No. 4,682,814, Hansen. Rather, the back support carrier 27 is essentially rod-like, or a frame support element, roughly similar to the type used with small back pads on, what is commercially known as "secretarial chairs", see the referenced Swiss Patent 524,982, Frey et al, for example. The actual back rest support 13 is secured to the upright arm 30 of the back rest support or holder 27 with screw 44. The back rest 13 may be constructed, as well known, with a core element 45, for example of laminated wood, plywood, chip-board or the like, a padding 49, and a cover 47. The cover 47 may be textile material, woven or knitted fabric, leather, plastic, imitation leather or other covering material. The padding 49 is usually present but not strictly necessary. Padding 49, preferably, is made of urethane or other plastic or rubber foam material. Preferably, padding 49 and cover 47 extend over the edge of the back support element or core 45 over the top, and around the sides up to about the vicinity of the upright arm 30 of the back rest support brace, structure or bracket 27 to form a turned-over portion 47'.

In "secretarial chairs", the upright arm is usually finished, for example chrome-plated, painted or lacquered. The portion of the cover 47 and padding 49 is, usually, secured to the core element 45 by staples or tacks, which can be applied by rapidly operating electric stapling or tacking guns or the like. The portion 49' of padding 49 is then covered with matching or contrasting material of cover 47 which, however, to prevent leaving a raw edge, has to be carefully turned in. Cover portion 47' is secured to and overlapped at the back and the side. Time and labor-intensive attachment methods are required to make a neat termination.

In accordance with the present invention, a cover element 51 is provided which can readily be secured by a plug-in connection 53 to the back support brace or bracket 27. The cover 51, preferably, is made of plastic. As best seen in FIG. 3, the cover 51 does not extend over the entire portion 47' of the back rest 13; it only covers it partially, but enough so that the cover 47' at the back rest is visible from the back and can be gripped around the edges, thus providing a pleasing, warm appearance, and "feel" of the chair if a user grips the edge of the back rest, for example to move the chair. As best seen in FIG. 1, the cover element 51 leaves uncovered a substantial portion of the cover 47 and portion 47' while, however, hiding the marginal or edge attachment region 47'' and the portion of the chair structure formed by holder 27, core element 45 and screws 44 at the back of the chair.

FIGS. 3, 4, 5 and 6 illustrate different shapes of the back rest 51. In FIG. 3, the back rest 51 is round; it is formed by a round shell 54, having a downwardly extending projection 55 which partially surrounds and hides the structural component forming the back rest brace or support 27. Consequently, the back rest support or brace 27 is not visible in FIGS. 2 to 6. The chair of all the figures may have the adjustment mechanism above described; the presence of such an adjustment mechanism is not, however, a necessary feature of the present invention and may be omitted. Cover 51 and the extension 55 can be used in chairs of any construction.

Figure 6:
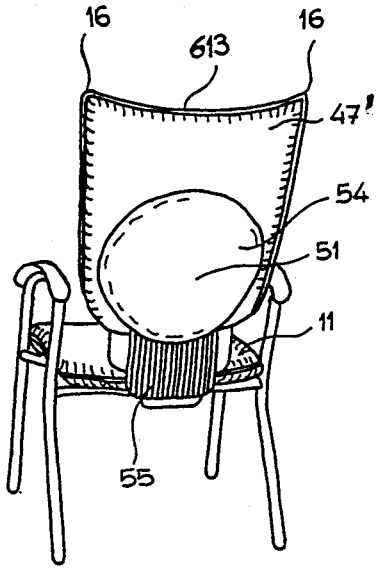
FIG. 6 view of a side chair and illustrating another embodiment of the present invention.
Figure 4:
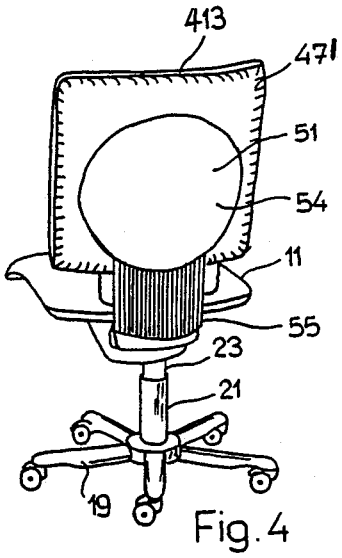
FIG. 4 is a view of a chair utilizing the components shown in FIGS. 1 to 3, and having a different configuration.
Figure 5:
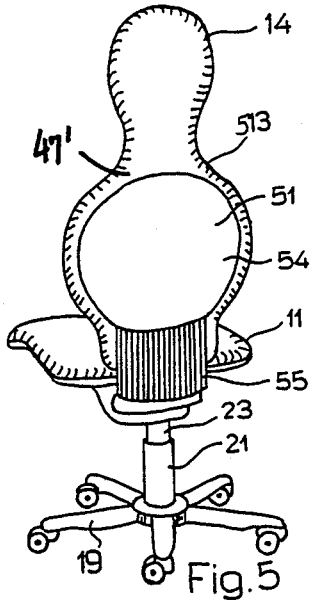
FIG. 5 is a view of a chair utilizing the components shown in FIGS. 1 to 3, and having a different configuration.

The shell 54 may have different shapes; it can be oval or polygonal. It is a specific advantage of the present invention that identical shells 51, 54 can be used for different types of chairs. FIG. 3 illustrates the use of a shell 54 with an essentially round back rest 13. FIG. 4 illustrates a chair with an essentially square back rest 413, and having the same shell 51, 54. FIG. 5 illustrates a chair with an extended back rest 513 and having a head rest 14. FIG. 6 illustrates a side chair which may or may not have a tilting mechanism, in which the back rest 613 has lateral extensions or wings 16.

Many changes and modifications may be made, and the design is highly versatile and adaptable to many different types of chairs, of different designs; the examples of FIGS. 2 to 6 clearly show that the back rests 13, 414, 513, 613 can be readily matched to any requirements of designers, and yet the cover for the support or holding structure 27 of the back rest can be identical. It is equally possible to consider wishes by customers to make chairs with specific and specially adapted shapes of back rests, even in small quantities. The covering 47 and the shape of the core 45 can be determined by the designer; the remainder of the chair structure can be standard. It is easily possible, also, to retrofit a chair once made with a specific type of back with another type of back. In a synchronous chair it is not necessary to interchange the back support brace 27 (FIG. 2). For example, the back rest 513 of the chair of FIG. 5 can readily be interchanged with the back rest 13 of the chair of FIG. 3.

The connection 53 of the shell 51 to the brace 27 can be effected by an interengaging projection-and-recess snap-in connection, for example by forming a slightly compressible or slit button on the panel forming the shell 51 and facing a receptacle molded on, secured on, or formed in the brace 27.

The invention thus permits modular construction and a simple and inexpensive stocking of sets of components and elements of chairs having basically different shapes, and to assemble chairs in accordance with customer or designer requirements, by utilizing the modular principle of making the seat 11 and seat cushion independent of the chair support structure and, further, providing a separate panel 51 which covers the portions of the fabric which, usually, are stapled to the core 53 and, unless specifically covered, require the most labor-intensive assembly operation. The invention, thus, permits assembly of chairs in different colors as well as different shapes, as required. This is particularly important in synchronous chairs, since the back support braces or carriers 27, and hence the adjustment mechanisms 25, of which the support carriers or braces 27 form a part, can always be identical. It is further possible to utilize a uniform cover element 51 for all the chairs. If a different color for the element 51 is desired, it is only necessary to add pigment to a molding material, utilizing the same molding form. It is the molding form that is expensive, not the pigmentation of the material. If a different color for the cover 51 is desired, the same molding form can be used with the different color additive. This permits high production quantities from a single mold, which has the substantial economic advantage that investment for a mold becomes economically feasible. An injection mold form thus permits economical manufacture of the component at a low individual component price.

The construction, additionally, permits, with minimum effort, to readily match chairs to fashion requirements or special requirements of customers or of designers. Stocking of replacement or repair parts is substantially simplified. Yet, the chairs have a warm look since the colors of the textile leather or other covering extend over the back side of the chair edges, both on top as well as at the side, so that looking at the chairs from the back—which is a frequent first glance at a chair—is pleasant; and gripping the chairs likewise leaves a pleasant "warm" feel in the user's hand rather than a cold metal or plastic rim.

I claim:

1. A modular system for assembling from stock components, selected models of pluralities of chairs, wherein some of the pluralities of chairs form first selected models, and others of the pluralities of chairs form other selected models; and in which each one of the chairs of all models includes a seat (11);

a back (13) having a surface directed towards the seat and defining a forward surface and a back surface opposite said forward surface, wherein the perimetrical contour of the backs of the chairs of different models differ in shape;

a back support element or brace (27) supporting the back;

a covering (47) covering the forward surface of the back;

the back support element or brace (27) being coupled to said seat (11);

said modular systems comprising a plurality of cover shell elements (51, 54) of identical shape and of selected colors and including a downwardly extending portion;

attachment means (53) for attaching the cover shell elements (51, 54) to the back surface of said back; wherein the downwardly extending portion extends over at least part of said back support element or brace and below the level of the seat; and said covering (4) of all the chairs of all the models including extending covering portions (47′) unitary with said covering (47) extending over at least part of the back surface of the back (13) and coverable by any one of said identical cover shell elements, said identical cover shell elements being dimensioned and shaped to leave uncovered a substantial part of said extending covering portions (47′);

and wherein said covering (47) and extending covering portions (47′) of the chairs of the first selected models and said other selected models differ from each other in shape.

2. The modular system of claim 1, wherein said cover shell elements (51, 54) are plastic shells.

3. The modular system of claim 1, wherein said cover shell elements (51, 54) are injection molded plastic shell structures.

4. The modular system of claim 1, wherein the back (13) has an upper surface and side surface;

and wherein the covering extending portion (47′) extends over the top and side surfaces towards a central region thereof.

5. The modular system of claim 1, wherein the back has an upper surface and side surfaces, and the covering (47) extends over the top and the side surfaces forming said extended covering portions (47), said extended covering portions being attached to the back in the vicinity of said support element or brace (27) at a region overlapped by a selected one of said cover shell elements (51, 54).

6. The modular system of claim 5, wherein said back (13) includes a support core (45);

and said extended covering portions (47′) are secured to said extending core by penetrating elements, said selected one of said cover shell elements (51, 54) overlapping and extending beyond marginal or edge portions (47″) of said covering portions and beyond said penetrating attachment elements.

7. The modular system of claim 6, wherein said cover shell elements (51, 54) are plastic shells.

8. The modular system of claim 6, wherein said cover shell elements (51, 54) are injection molded plastic shell structures.

9. The modular system of claim 5, wherein said cover shell elements (51, 54) are plastic shells.

10. The modular system of claim 5, wherein said cover shell elements (51, 54) are injection molded plastic shell structures.

11. The modular system of claim 1, wherein each chair includes padding means (49, 49′) beneath the covering (47) and extending also at least in part beneath said covering portions (47′).

12. The modular system of claim 1, wherein each chair includes a seat adjustment mechanism (25, 31, 35, 37, 39, 41) coupled to the seat 11.

13. The modular system of claim 1, wherein said attachment means (53) for said cover shell elements (51, 54) and include snap-in interengaging projection-and-recess means on the cover shell elements and on said back support elements, or braces (27), respectively, to retain the cover shell elements (51, 54) in position on the chairs.

* * * * *